United States Patent [19]

Huey

[11] Patent Number: 4,948,408

[45] Date of Patent: Aug. 14, 1990

[54] STRAND DEFLECTOR FOR A WIDE BAND MAT

[75] Inventor: Larry J. Huey, Granville, Ohio

[73] Assignee: Owens-Corning Fiberglas Corporation, Toledo, Ohio

[21] Appl. No.: 430,212

[22] Filed: Nov. 1, 1989

[51] Int. Cl.[5] ..... C03B 37/02

[52] U.S. Cl. ..... 65/9; 65/4.4; 156/62.4; 156/62.6

[58] Field of Search ..... 65/4.4, 9; 156/62.4, 156/62.6

[56] References Cited

U.S. PATENT DOCUMENTS

| | | | |
|---|---|---|---|
| 2,318,244 | 5/1943 | McClure | 65/9 X |
| 2,736,676 | 2/1956 | Frickert | 65/9 X |
| 2,981,999 | 5/1961 | Russell | 65/9 X |
| 3,236,616 | 2/1966 | Stalego et al. | 65/9 X |
| 3,393,985 | 7/1968 | Langlois et al. | 65/9 |
| 3,511,625 | 5/1970 | Pitt | 65/4.4 X |
| 4,345,927 | 8/1982 | Picone | 65/9 |

*Primary Examiner*—Robert L. Lindsay

*Attorney, Agent, or Firm*—Patrick P. Pacella; Ted C. Gillespie; David D. Murray

[57] ABSTRACT

A strand deflector widens the band of fibers from a continuous strand mat pull wheel. The strand deflector defines a plate having a surface with discontinuities such as a pattern of transverse parallel grooves or oblique intersecting grooves. The plate is disposed below the pull wheel and is coupled to and oscillates with the spoked wheel disposed within the pull wheel. The band of fibers impinges upon the plate at a acute angle and is deflected, broadening the width of the band, typically from four to five inches to ten to twenty inches. Higher throughputs and faster line speeds are thus possible for continuous strand mat production lines.

18 Claims, 3 Drawing Sheets

STRAND DEFLECTOR FOR A WIDE BAND MAT

BACKGROUND OF THE INVENTION

The invention relates generally to improvements in apparatus for the production of continuous strand fiber glass mats and more particularly to an apparatus for diffusing or widening the band width of strands from a pull wheel in a mat forming apparatus.

The production of continuous strand mats has reached a high state of development. For example, U.S. Pat. No. 3,599,848, granted Aug. 17, 1971, teaches a method and apparatus for distributing strands on a conveyor mat using aerodynamically configured nozzles and air foil members. The distribution of the strands on a collecting surface may be adjusted by controlling the flow of fluid through the nozzles or air foils.

U.S. Pat. No. 3,936,558, granted Feb. 3, 1976, relates to the production of a continuous fiber mat. In this patent, a product which includes at least two layers of strands of continuous glass filaments, is disclosed. In one layer, the filaments of the strands are arranged to form a mesh size which traps binder particles therein. The strands in another layer form a larger mesh size.

Significant attention has been accorded the subject of diffusing the filaments of the strands. In U.S. Pat. No. 4,515,613, granted May 7, 1985, the strands pass through a nozzle where they contact a high velocity planar gaseous stream. The gaseous stream imparts energy to the strands and separates them, significantly widening the band width of the plural strands.

A similar apparatus utilizing a high velocity gaseous stream is disclosed in U.S. Pat. No. 4,600,423 granted July 15, 1986. Once again, the strands of filaments pass through a nozzle where they contact a high velocity gaseous stream. The turbulence created by the stream separates the strands and individual filaments and broadens the band width of the strands as they exit the nozzle and fall upon the collecting conveyor.

The foregoing devices may be characterized as active strand diffusers in that external energy in the form of a high velocity gaseous stream is supplied to the nozzle. U.S. Pat. No. 3,265,482, granted Aug. 9, 1966, discloses a passive deflector. In this patent, a cylindrical deflector fabricated of screen is disposed for oscillation with the spoke wheel within the pull wheel such that the relative angles between the deflector and the spoke wheel remain constant during oscillation of these components about the pull wheel. The porous nature of the screen deflector is said to be beneficial as it lessens the turbulence of air occurring at the surface of the deflector which ordinarily causes an undesirable irregularity in the path of the strands.

As demands for increased production have risen, every aspect of continuous strand mat fabrication apparatus has undergone scrutiny. An area that has continued to undergo such scrutiny are the means and method of dispersing the individual strands from a pull wheel to effectively extend the area over which the fibers are dispersed on the conveyor and thus improve production throughput. The present invention relates to such improvements.

SUMMARY OF THE INVENTION

A strand deflector widens the band of strands from a continuous strand mat pull wheel. The strand deflector defines a solid plate having a surface with discontinuities such as a pattern of transverse parallel grooves or oblique intersecting grooves. Numerous materials and surface patterns are functional; the primary criteria of each being durability and smoothness on a microscale to prevent snagging of the filaments. The plate is disposed below the pull wheel and is coupled to and oscillates with the spoked wheel disposed within the pull wheel. Such action ensures that the angle of incidence of the strands on the plate remains constant. The band of strands impinges upon the plate at a acute angle and is deflected, broadening the width of the band, typically from four to five inches to ten to twenty inches. Higher throughputs and faster line speeds are thus possible for continuous strand mat production lines. Alternate embodiments include a deflector plate having an air plenum and nozzle slot disposed across the upper edge of the deflector which provides a moving boundary layer of air on the surface of the deflector and a configuration including a pair of opposed deflectors oriented at a small acute angle which define a throat through which the strands of filaments pass.

DESCRIPTION OF THE PREFERRED AND ALTERNATE EMBODIMENTS

Figure 1:
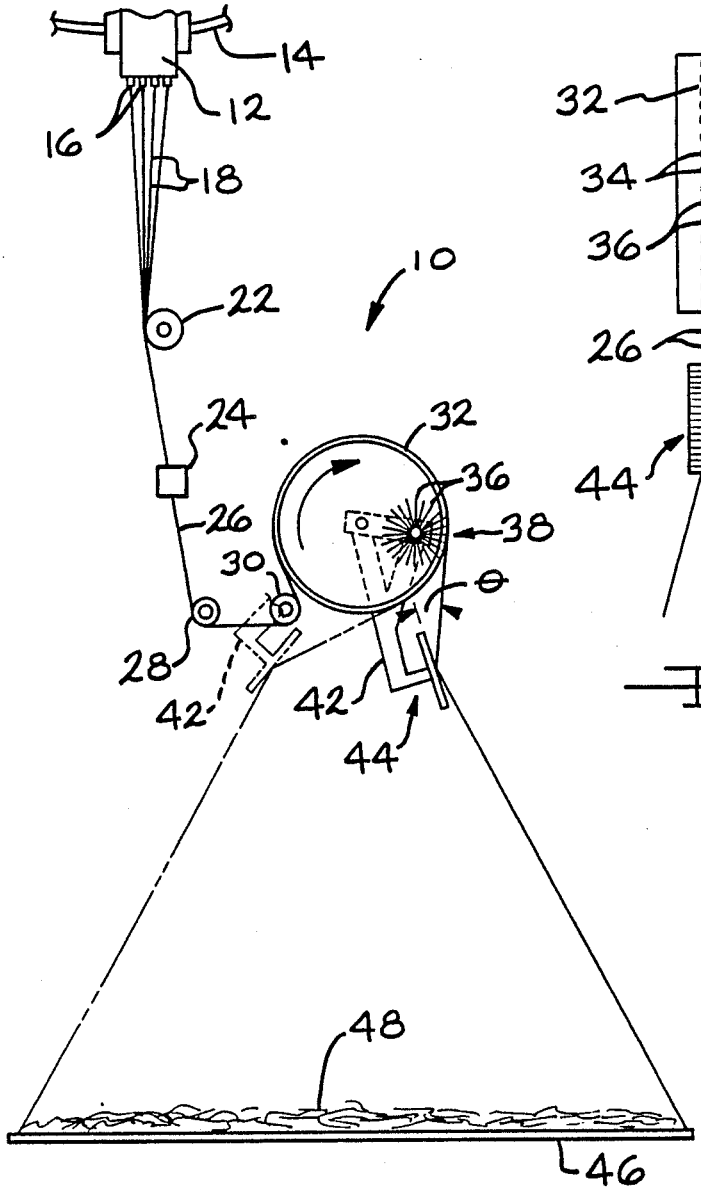
FIG. 1 is a diagrammatic, front elevational view of a fiber and mat producing apparatus incorporating the present invention.
Figure 2:
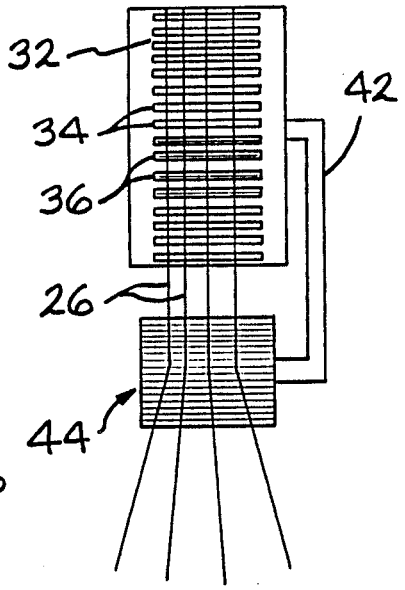
FIG. 2 is a side elevational view of a pull wheel and deflector apparatus according to the present invention.

Referring now to FIGS. 1 and 2, a portion of a continuous strand mat production apparatus incorporating the present invention is illustrated and generally designated by the reference numeral 10. The continuous strand mat production apparatus 10 includes a bushing 12 which is electrically heated through power supplied by cables 14 and which defines a plurality of orifices 16 through which molten glass flows and forms a plurality of glass filaments 18. The bushing 12 and the orifices 16 may be of any suitable design.

The plurality of filaments 18 first encounter an applicator wheel 22 which supplies a protective coating or size to the translating filaments 18. Adjacent the applicator wheel 22 is a gathering shoe 24 having a plurality of spaced apart grooves or notches (not illustrated) which gather the plurality of filaments 18 into a smaller plurality of strands or bundles 26. Preferably, each strand or bundle 26 comprises approximately the same number of filaments 18. The gathering shoe 24 not only ensures substantially equal inter-strand spacing of the strands or bundles 26 but also that they are parallel and define a plane, said plane being viewed edge on in FIG. 1. Idler rollers 28 and 30 next engage the strands or bundles 26. Preferably, the idler rollers 28 and 30 define a plurality of parallel, circumferential grooves which maintain the individual integrity of each of the strands or bundles 26.

Disposed for rotation on an axis parallel to the axes of the idler rollers 28 and 30 and the applicator wheel 22 is a pull wheel 32. The pull wheel 32 is rotated by an energy source (not illustrated) in the direction illustrated by the arrow in FIG. 1 and draws and attenuates the plurality of filaments 18 from the orifices 16 of the bushing 12. It will be appreciated that the rotational speed of the pull wheel 32 may be adjusted to vary attenuation of the filaments 18; the faster the rotational speed, the greater the attenuation and vice versa.

Preferably, the peripheral surface of the pull wheel 32 is substantially uniform and maintains the integrity and spacing of the strands or bundles 26. The periphery of the pull wheel 32 defines a plurality of axially extending, circumferentially spaced apart slots 34 through which may protrude blades or spokes 36 of a spoked wheel 38 positioned within the pull wheel 32. The axis of the spoked wheel 38 is parallel to the axis of the pull wheel 32 and it rotates at the same peripheral speed. The spoked wheel 38 is mounted upon an oscillating frame 42 having its axis of oscillation coincident with the rotational axis of the pull wheel 32. The oscillating frame 42 extends radially from the pull wheel 32 and supports a deflector assembly 44.

It will thus be appreciated that the strands or bundles 26 wrap about the periphery of the pull wheel 32 to the point where the spokes 36 of the spoked wheel 38 disengage them from the peripheral surface of the pull wheel 32. The strands or bundles 26 then travel tangentially from the pull wheel 32 until they encounter the deflector assembly 44. The deflector assembly 44 redirects the strands or bundles 26 and expands the total width of the band defined by the strands 26 as will be more fully described subsequently. The strands or bundles 26 are deposited on a conveyor 46 to produce a mat 48 of continuous glass strands 26 of filaments 18 disposed in overlapping, looping, swirled and interengaging arrangements.

Figure 3:
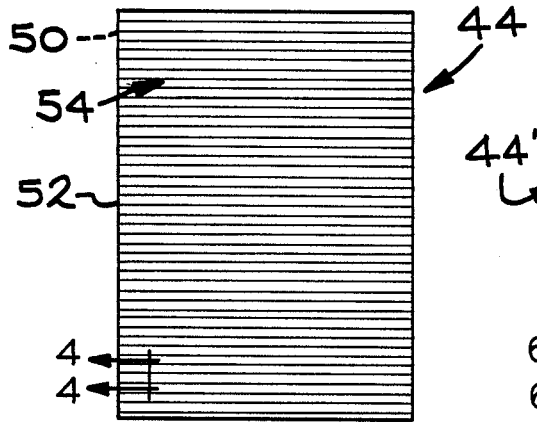
FIG. 3 is a front elevational view of a preferred embodiment of the deflector apparatus according to the instant invention.
Figure 4:
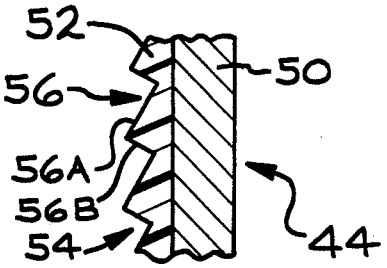
FIG. 4 is a fragmentary sectional view of the preferred embodiment of the deflector apparatus according to the present invention taken along the line 4—4 of FIG. 3.

Referring now to FIGS. 2, 3 and 4, the deflector assembly 44 defines a rectangular support plate 50. The width of the rectangular support plate 50 is substantially equal to the width of the pull wheel 32. The rectangular support plate 50 is preferably metal and supports a deflector plate 52 having a specially configured surface 54. It will be appreciated that the significant characteristics of the surface 54 are, first of all, that, on a macroscale, it is interrupted by discontinuities such as grooves, creases, channels, wrinkles and similar shapes defining relatively higher and lower regions. Because the strands 26 are wet, surface tension between the strands 26 and the surface 54 of the deflector plate 52, would cause the strands 26 to stick if it were smooth. The discontinuities alleviate this condition by breaking the surface tension. Second of all, on a microscale, the surface 54 is smooth so that the strands 26 and filaments 18 are not snagged. Two specific configurations of the surface 54, of many functional surfaces which respond to these criteria, are illustrated in FIGS. 2 and 3.

The deflector plate 52 may be fabricated of a relatively hard plastic, other organic material or metal, the prime criteria being durability and resistance to wear caused by the impingement of the strands or bundles 26 thereupon. Urethane having a Durometer hardness of about 75 has been found to be an ideal material. If the deflector plate 52 is fabricated of metal, the rectangular support plate 50 and the deflector plate 52 may be combined into a unitary structure. This configuration is described below as the first alternate embodiment deflector plate 44'.

The deflector plate 52 preferably defines a plurality of horizontally (i.e., transversely) extending grooves 56 having a saw tooth configuration and profile. Preferably, the depth of the teeth or grooves 56 is approximately 0.0625 inches and groove-to-groove spacing is approximately 0.125 to 0.1875 inches. The longer surface 56A of each of the grooves 56 is preferably disposed at an angle of approximately 25° from the plane of the deflector plate 52 and the shorter surface 56B of the tooth or groove 56 is disposed at an angle of approximately 80° from the plane of the deflector plate 52. It will be appreciated that these dimensions and angular relationships are functional with the production parameters presently encountered. Accordingly, they may both be varied over a significant range with the dimensional and angular limits and optimum dimensions and angles being determined by such factors as strand size, filament size, strand speed and other production variables.

In operation, the front surface 54 of the deflector plate 52 is disposed at an angle $\theta$ of between about 20° and 30° to the direction of travel of the strands 26 departing tangentially from the pull wheel 32. The angle $\theta$ is the angle of incidence between the plane nominally defined by the front surface 54 of the deflector plate 52 and the strands or bundles 26 of filaments 18 approaching it from the pull wheel 32. See FIG. 1. A functional range of the angle $\theta$ is from 15° to 35° and the deflector assembly 44 will provide dispersal of the bundles or strands 26 when disposed at an angle of between 10° and 45°. Once again, production variables such as those delineated above and others will determine the optimum operating angle which, under certain circumstances, may be outside the limits stated directly above.

Figure 5:
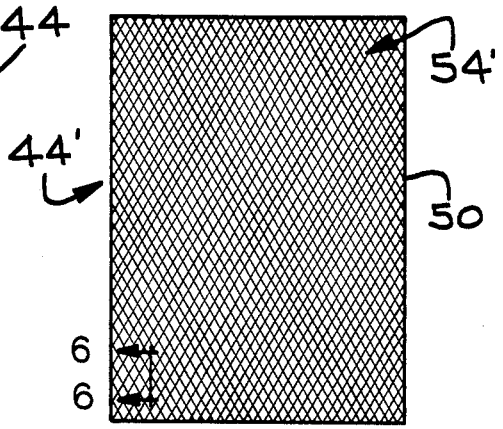
FIG. 5 is a front elevational view of a first alternate embodiment strand deflector apparatus according to the present invention.
Figure 6:
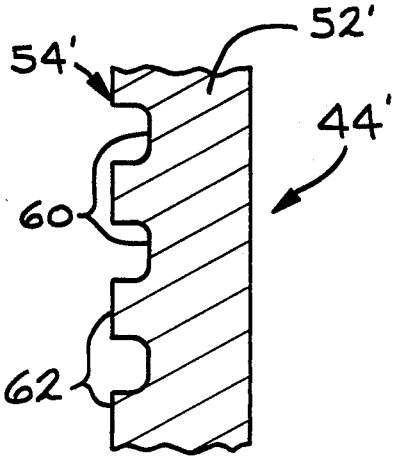
FIG. 6 is a fragmentary sectional view of a first alternate embodiment strand deflector apparatus according to the present invention.

Referring now to FIGS. 5 and 6, a first alternate embodiment deflector assembly 44' is illustrated. The first alternate embodiment deflector assembly 44' is unitary, that is, preferably fabricated of metal, thereby eliminating the need for the deflector support plate 50. The deflector plate 52' includes a plurality of oblique parallel and intersecting grooves or channels 60 oriented at angles of 60° to one another. The channels 60 are preferably approximately 0.0625 inches deep and 0.0937 inches wide. The lands 62 between the grooves 60 are likewise preferably about 0.0937 inches wide. Again, the surface 54' of the deflector plate 52' must be smooth on a microscale to avoid snagging the strands or bundles 26 of the filaments 18. The first alternate embodiment deflector assembly 44' may be fabricated of any metal exhibiting suitable durability for extended service life. It will be understood that the first alternate embodiment deflector assembly 44' functions in the same manner and is utilized with a pull wheel 32 and an oscillating frame 42 in the same manner as the preferred embodiment deflector assembly 44.

Figure 7:
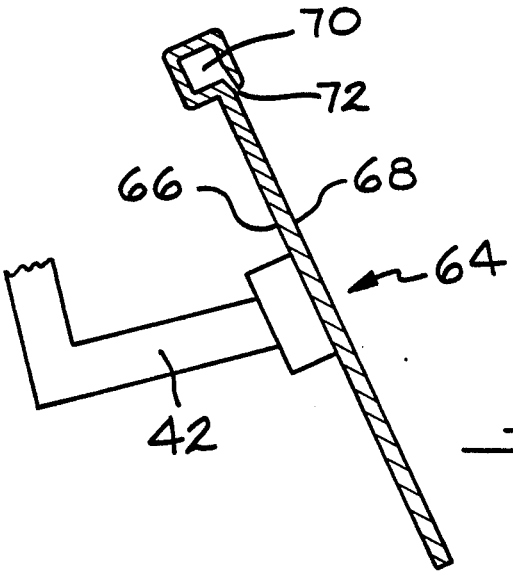
FIG. 7 is a full sectional view of a second alternate embodiment strand deflector apparatus according to the instant invention.

Turning now to FIG. 7, a second alternate embodiment deflector assembly 64 is illustrated. The second alternate embodiment deflector assembly 64 includes a deflector plate 66 having a front surface 68 configured according to either the preferred embodiment 44, the first alternate embodiment 44' or other scheme having regular or random discontinuities over the front surface 68. The deflector assembly 64 further includes an air plenum 70 extending substantially fully across the width of the deflector plate 66. The air plenum 70 is charged with compressed air at a pressure of between 30 and 40 p.s.i. from an external source of compressed air (not illustrated). A slot or nozzle 72 communicating with the air plenum 70 also extends substantially across the full width of the deflector plate 66 and directs a boundary layer of moving air along the front surface 68 of the deflector plate 66. The moving boundary layer of air provided by the compressed air in the plenum 70 which exits through the nozzle 72 minimizes the likelihood of snagging of the strands or bundles 26 on the front surface 68 of the deflector plate 66 and imparts additional kinetic energy to the strands or bundles 26 which assists in the widening of their band width. Again, the use and operation of the second alternate embodiment deflector assembly 64 is like that of the preferred embodiment assembly 44.

Figure 8:
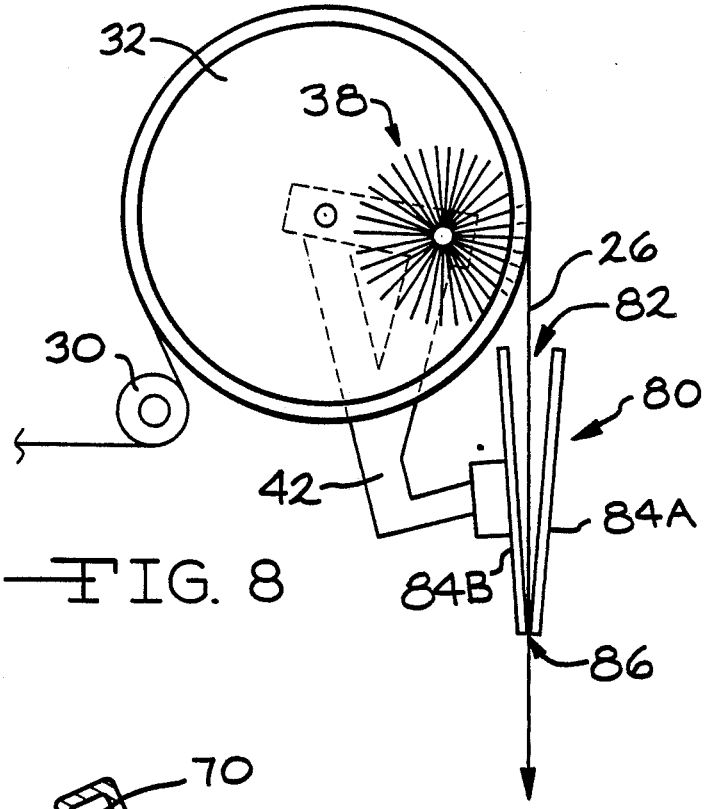
FIG. 8 is a diagrammatic view of a pull wheel and strand deflector apparatus according to a third embodiment of the present invention.

Turning now to FIG. 8, a third alternate embodiment deflector assembly 80 is illustrated. The strands or bundles 26 exiting the pull wheel 32 are received within the throat 82 of a pair of opposed deflector plates 84A and 84B. The deflector plates 84A and 84B are oriented at a small acute angle to one another and define a narrow gap 86 extending across the width of the deflector plates 84A and 84B through which the strands or bundles 26 pass. The opposed inner surfaces of the deflector plates 84A and 84B may be like that of either the preferred embodiment 44, the first alternate embodiment 44' or other configuration exhibiting surface discontinuities.

It will be appreciated that the strand deflector of the present invention facilitates expanding the band width of strands of filaments for utilization in a continuous fiber mat production line. Accordingly, both the filament and strand production rate as well as the conveyor and mat speed may be increased. Significant improvements in overall production rates of continuous strand fiber mats are therefore possible.

The foregoing disclosure is the best mode devised by the inventor for practicing this invention. It is apparent, however, that devices incorporating modifications and variations will be obvious to one skilled in the art of fiberglass production. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. In a continuous strand mat production apparatus including a multiple orifice bushing, a pull wheel defining an axis and having an internal oscillating spoked wheel and a conveyor, the improvement comprising, a member disposed for oscillation with said spoked wheel about said axis of said pull wheel, and a deflector plate coupled to said member, said deflector plate having a solid surface oriented at an acute angle to strands of fibers exiting tangentially from said pull wheel, said surface defining discontinuities having higher and lower surface regions.

2. An apparatus for production of continuous strand glass fiber mats comprising, in combination, a multiple orifice bushing for producing a plurality of glass filaments, means for applying sizing to said filaments, a pull wheel defining an axis, a member disposed for oscillation about said axis, a deflector plate secured to said member, said deflector plate having a solid surface oriented at an acute angle to strands of filaments moving tangentially from said pull wheel, said surface of said deflector plate having discontinuities defining regions of relatively raised areas and lowered areas.

3. The improvement of claim 1 wherein said discontinuities are a plurality of parallel grooves.

4. The improvement of claim 1 wherein said discontinuities are a plurality of transversely oriented saw-tooth grooves.

5. The improvement of claim 1 wherein said discontinuities include a first plurality of parallel grooves and a second plurality of parallel grooves intersecting said first plurality of parallel grooves at a second acute angle.

6. The improvement of claim 5 wherein said second acute angle is about 60°.

7. The improvement of claim 1 wherein said deflector plate further includes an air plenum and nozzle means communicating with said air plenum for providing a moving boundary layer of air along said surface of said deflector plate.

8. The improvement of claim 1 wherein said acute angle is between 20° and 30°.

9. A strand deflector for widening strands of filaments comprising, in combination, a strand pull wheel defining an axis, a spoked wheel disposed within said pull wheel for oscillation about said axis, a member disposed for oscillation about said axis with said spoked wheel, a deflector plate secured to said member, said deflector plate having a solid surface oriented at an acute angle to strands of filaments exiting tangentially from said pull wheel, said surface of said deflector plate having discontinuities defining regions of relatively higher areas and lower areas.

10. The strand deflector of claim 9 further including bushing means for producing a plurality of filaments and sizing means for applying sizing to said filaments.

11. The apparatus of claim 2 wherein said discontinuities in said deflector plate are a plurality of transversely oriented saw-tooth grooves.

12. The strand deflector of claim 9 wherein said discontinuities are a plurality of parallel grooves.

13. The strand deflector of claim 9 wherein said discontinuities are a plurality of transversely oriented saw-tooth grooves.

14. The strand deflector of claim 9 wherein said discontinuities include a first plurality of parallel grooves and a second plurality of parallel grooves intersecting said first plurality of parallel grooves at a second acute angle.

15. The strand deflector of claim 14 wherein said second acute angle is about 60°.

16. The strand deflector of claim 9 wherein said deflector plate further includes an air plenum and nozzle means communicating with said air plenum for providing a moving boundary layer of air along said surface of said deflector plate.

17. The strand deflector of claim 9 wherein said acute angle is between 20° and 30°.

18. The strand deflector of claim 9 further including a second deflector plate spaced from and facing said deflector plate, said plates defining a throat for receiving said strands of filaments.

* * * * *